US006533121B1

(12) United States Patent
Ross

(10) Patent No.: US 6,533,121 B1
(45) Date of Patent: Mar. 18, 2003

(54) PALLETIZED BULK BAG

(75) Inventor: Kurt D. Ross, El Paso, TX (US)

(73) Assignee: Grayling Industries, Inc., Alpharetta, GA (US)

( * ) Notice: Subject to any disclaimer, the term of this patent is extended or adjusted under 35 U.S.C. 154(b) by 0 days.

(21) Appl. No.: 09/299,452

(22) Filed: Apr. 26, 1999

(51) Int. Cl.[7] ..... B65D 19/00
(52) U.S. Cl. ..... 206/599; 206/600
(58) Field of Search ..... 206/386, 595, 206/596, 597, 598, 599, 600, 522; 108/53.1, 55.1, 57.31, 51.11; 410/119; 383/3, 121; 414/676

(56) References Cited

U.S. PATENT DOCUMENTS 2,446,914 A * 8/1948 Fallert et al. ..... 206/599
3,552,466 A 1/1971 Fairchilds
3,826,329 A 7/1974 Crimmins et al.
3,834,556 A 9/1974 Crimmins
3,858,526 A * 1/1975 Lombard et al. ..... 206/386
3,913,764 A * 10/1975 Stirling et al. ..... 108/52.1
3,942,654 A * 3/1976 Warrick ..... 206/599
3,948,344 A 4/1976 Johnson et al.
4,079,907 A * 3/1978 Mykleby ..... 206/599
4,116,344 A * 9/1978 Ziemba ..... 206/522
4,399,885 A 8/1983 Johnson et al.
4,790,249 A * 12/1988 Webb ..... 206/599
5,005,702 A * 4/1991 Davis et al. ..... 206/522
5,158,369 A * 10/1992 Derby ..... 383/121
5,445,274 A 8/1995 Pharo
5,685,644 A * 11/1997 Taylor ..... 383/121
5,819,943 A * 10/1998 Depuy ..... 206/522

* cited by examiner

*Primary Examiner*—Luan K. Bui
(74) *Attorney, Agent, or Firm*—Baker, Donelson, Bearman & Caldwell

(57) ABSTRACT

A palletized container for bulk materials comprises a bag made of reticulated material having a bottom and sides. Inflatable bladders are mounted to the bag bottom which bound two channels that are spaced apart a distance to receive two spaced tines of a forklift truck.

8 Claims, 3 Drawing Sheets

PALLETIZED BULK BAG

TECHNICAL FIELD

This invention relates to containers for storing and transporting materials in bulk form which are commonly known as bulk bags.

BACKGROUND OF THE INVENTION

Bulk bags are widely used today in storing and transporting bulk materials in granular and powder form and sometimes in liquid or slurry form. These bulk bags are usually made of flexible reticulated materials such as woven polypropylene which are capable of holding large, heavy quantities of materials, typically weighing a ton or so. Where the bulk material is liquid or needs to be protected from ambient moisture, the bag is lined with an impervious liner made also of a flexible material such as polyethylene or nylon. For storage compactness, bulk bags are normally square with a bottom, four continuous sides and usually a top. They commonly have a fill chute which extends centrally from their tops and a discharge chute which depends centrally from their bottoms.

Once filled, bulk bags are usually moved about by forklift trucks. For example, they are often moved from beneath a hopper where they are filled to a warehouse storage area and to and from shipping docks where they are loaded and unloaded onto trucks, trains and container ships. In order to be loaded onto the tines of a forklift truck their bottoms must be elevated a little from the floor upon which they are supported. Otherwise the tines would puncture the bags and create a spill. Thus heretofore they have been supported upon pallets.

Heretofore, the use of conventional pallets has been accepted as simply a necessity. These pallets are usually made of a wood frame with a flat top supported a few inches above a flat bottom by spaced ribs. In loading a bulk bag upon a forklift truck the truck tines are lowered and driven into a gap in the ribs of the pallet between the pallet top and bottom. The tines are then lifted, usually titled and the loaded truck driven to another location where the bag is unloaded.

The use of pallets is very expensive. They are usually hand made by sawing plywood and boards and nailing the pieces together to form an assembled pallet. They are usually stored in stacks. Being subjected to rough handling they are often broken in use and have to be repaired or replaced. The damaged pallets and their pieces must thus be gathered and discarded. Even when they are not damaged they must be stored when not in use.

It thus is seen that if a way were to be found to avoid the use of conventional wooden pallets for the handling of bulk bags, a definitive advance would be achieved. Accordingly it is to this end that the present invention is primarily directed.

SUMMARY OF THE INVENTION

Briefly described, a palletized container for bulk materials comprises a bulk bag having a flexible bottom and flexible sides. An inflatable stand is mounted to the bag bottom. The inflatable stand has two elongated channels spaced apart a distance to receive two tines of a forklift truck. Prior to and between uses the container may be compactly stored with its sides furled and its stand deflated. For use the stand is inflated and the sides unfurled as with lifting straps attached to their top corners.

In another form of the invention a palletized container for bulk materials comprises a bag made of reticulated material having a bottom and sides. Inflatable bladders are mounted to the bag bottom which bound two tine receiving channels spaced apart a distance to receive two spaced tines of a forklift truck. A discharge chute may depend from the center of the bag bottom into another channel bounded by two of the inflatable bladders. Sheets preferably cover the bottoms of the two tine receiving channels.

DETAILED DESCRIPTION

Figure 1:
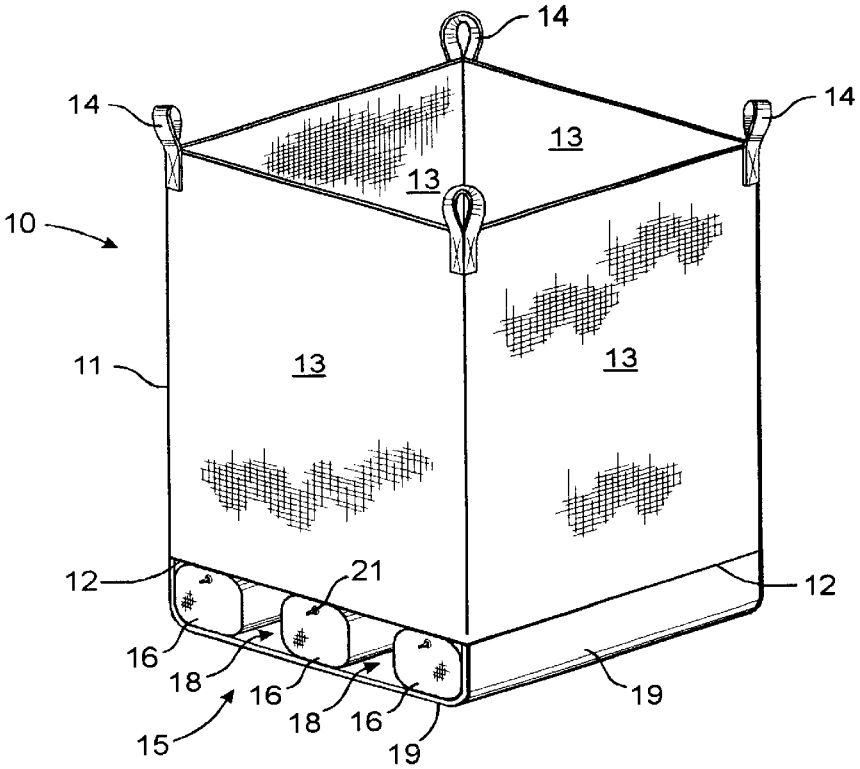
FIG. 1 is a perspective view of a palletized bulk bag that embodies principles of the invention in a preferred form shown in an inflated, fully erected configuration.
Figure 2:
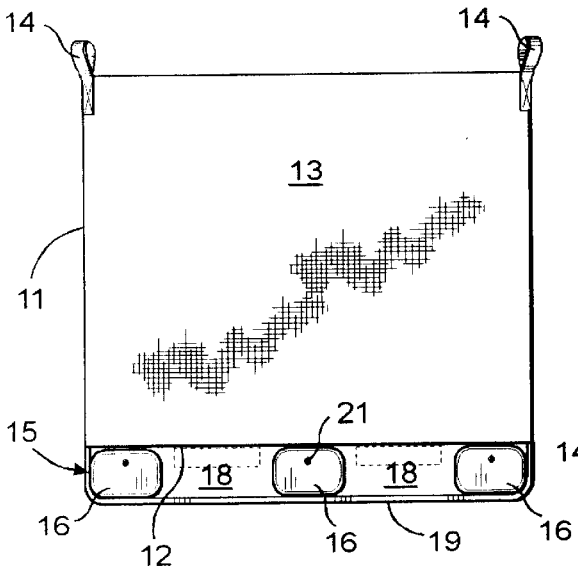
FIG. 2 is a side view of the palletized bulk bag shown in FIG. 1.

Referring now in more detail to the drawing, there is shown in FIGS. 1–5 a palletized bulk bag type container 10. The container has a bulk bag 11 made of reticulated material. The bulk bag has a square bottom 12 and four sides 13. It also has four lifting loops 14 attached to the tops of the sides at their four corners. The bulk bag is palletized by means of an integral, inflatable stand shown generally at 15. The stand has three elongated, inflatable bladders 16 which are mounted in parallel, spaced relation with each other to the bottom side of the bulk bag bottom 12. In this manner two spaced channels 18 are provided which are bounded by confronting sides of the adjacent bladders 16 and the bulk bag bottom 12. These channels are closed at their bottoms by a sheet 19 which is secured to the bottoms of the three bladders 16 and to the outboard sides of the two outboard bladders. The bladders are made of an air impervious flexible plastic such as polypropylene. Each bladder has a conventional air fill valve 21 which preferably is of a self-sealing dunnage type. Alternatively, the interiors of the three bladders may be placed in fluid communication by a manifold mounted along the sheet 19. In that case only one fill valve is needed.

With this construction the palletized bulk bag may be stowed in a flat, compact, deflated and unfurled configuration. For use it is unfurled as shown being done in FIG., 5 by lifting the straps 14 and inflating the bladders with pressurized air. Once this is done the container assumes the configuration shown in FIG. 1. With the bladders 16 now inflated the channels 18 become well defined. The bag may then be filled with bulk goods.

Figure 3:
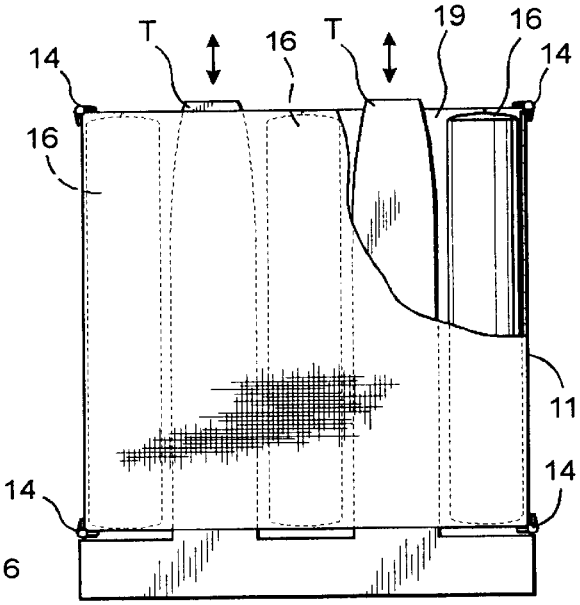
FIG. 3 is a top view of the palletized bulk bag shown in FIG. 1 shown mounted on the tines of a forklift truck.
Figure 4:
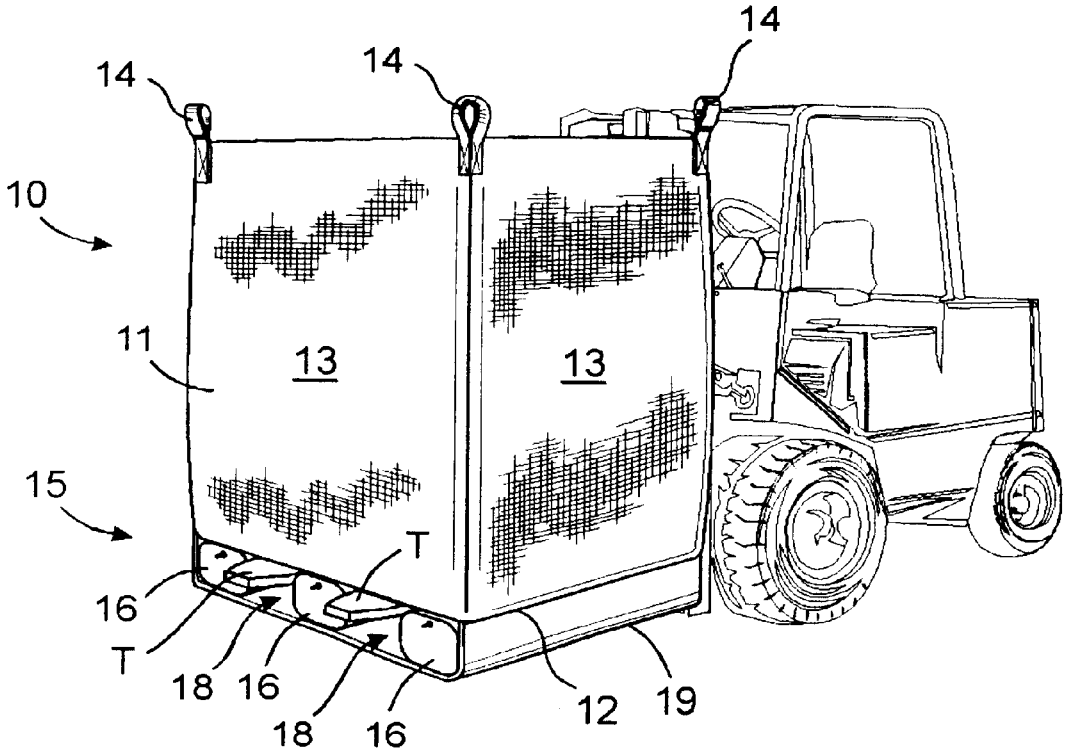
FIG. 4 is a perspective view of the palletized bulk bag of FIG. 1 shown filled and loaded on a forklift truck.
Figure 5:
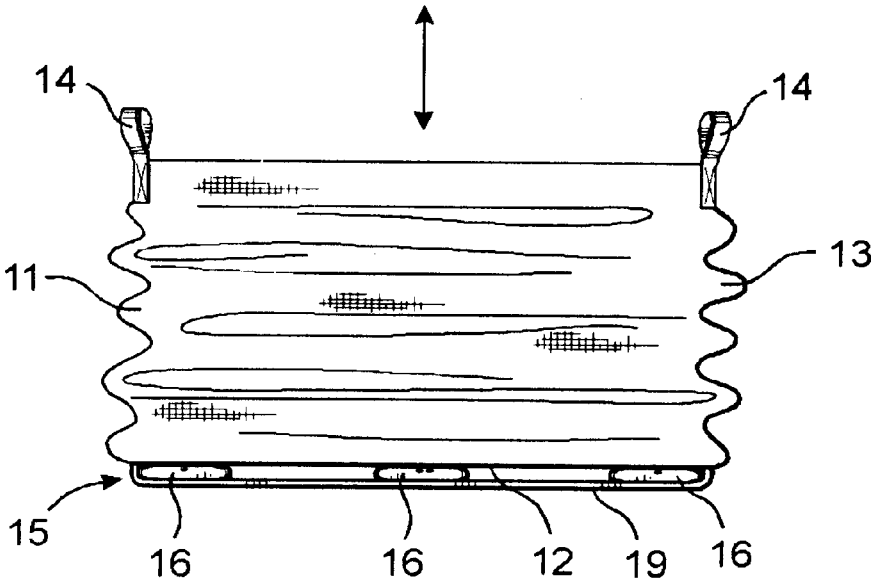
FIG. 5 is a side view of the palletized bulk bag of FIG. 1 in a deflated and partially unfurled configuration.

To move the container, it is loaded onto a forklift truck as seen in FIGS. 3 and 4. This may be done without the bag yet unfurled, with only the bladder inflated. The tines of the truck are moved into the channels 18 and raised against the bag bottom 12. A loaded container can then be moved by the forklift to another location. During transit the tines are usually tilted backward a little for transport stability. Should the forklift stop abruptly, the bag is prevented from tumbling forward and off the tines by the sheet 19. Once relocated the tines are lowered to bring the container down to rest on the supporting floor and then the tines removed by backing up the forklift. Later, after unloading, the container may reassume its compact configuration for storage by unhooking the straps 14 and deflating the bladders.

Figure 6:
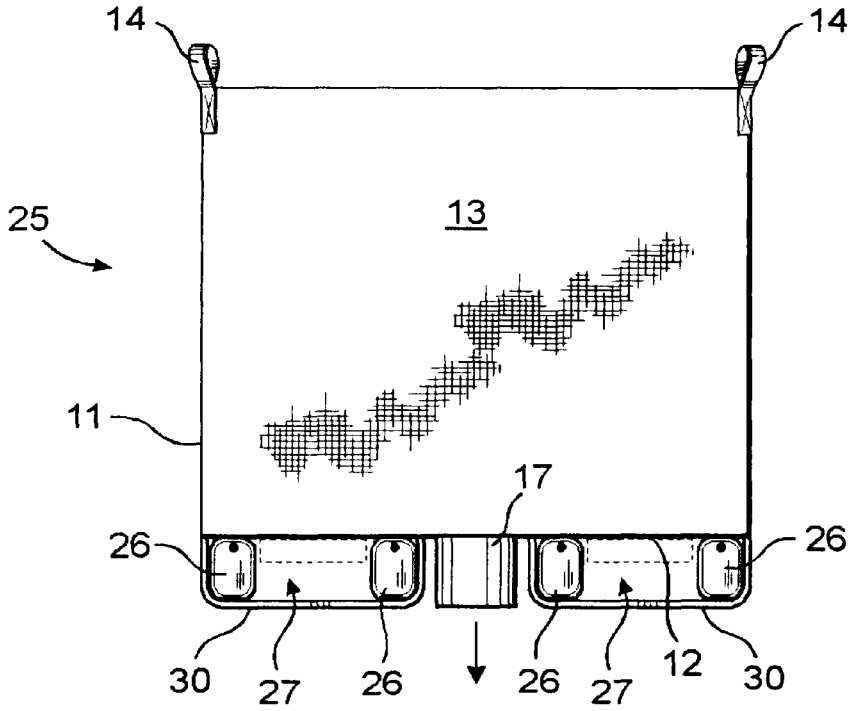
FIG. 6 is a perspective view of a palletized bulk bag that embodies principles of the invention in another preferred form shown in an inflated, erected configuration.
Figure 7:
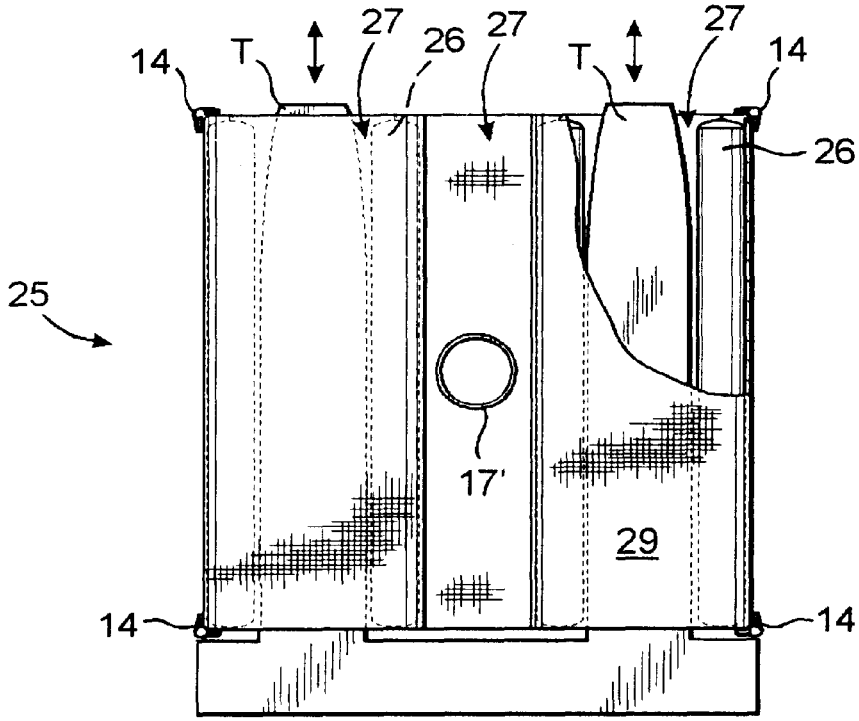
FIG. 7 is a top view of the palletized bulk bag of FIG. 6 shown mounted on the tines of a forklift truck.

With reference next to FIGS. 6 and 7 a container 25 is shown which embodies the invention in an alternative form. As before, it includes a conventional bulk bag 11 having a bottom 12, sides 13 and lifting straps 14. Here however it has a conventional discharge chute 17 that depends from the center of the bottom 12 that may be releasibly tied off with a tie line. It also has a top cover 29 and a fill chute 17'. Again it has an integral stand. Here the stand comprises four, elongated, inflatable bladders 26 that are mounted to the bag bottom 12 in mutually spaced, parallel relation to define three channels 27. The bottoms of the two outboard channels are closed by sheets 30 while the center, inboard channel has an open bottom which accommodates the discharge chute 17. Usage is essentially the same as before except for the provision of the discharge chute. With this construction the bulk bag may be readily emptied while remaining fully palletized. Before this was not possible without special modification of the wooden pallet itself.

It thus is seen that a palletized bulk bag is now provided which may be stowed away in a compact, flat, deflated and unfurled configuration when not in use. For use it is unfurled and inflated whereupon it is ready for filling, for transport and for emptying all without the use of a conventional pallet. Though the new container has been shown and described in its preferred form, it should be understood that many modifications, additions and deletions may be made thereto without departure from the spirit and scope of the invention as set forth in the following claims.

What is claimed is:

1. A palletized container for bulk materials comprising a bulk bag having a flexible bottom and flexible sides and an inflatable stand mounted to said bottom with two elongated channels therein spaced apart a distance to receive two tines of a forklift truck.

2. The palletized container of claim 1 wherein said stand has a sheet covering the bottoms of said channels.

3. The palletized container of claim 1 wherein said inflatable stand has at least three elongated, spaced, inflatable bladders.

4. The palletized container of claim 3 wherein said bulk bag has a discharge chute located between two of said bladders.

5. A palletized container for bulk materials comprising a bag made of reticulated material having a bottom and sides and a plurality of inflatable bladders mounted to said bag bottom with said bladders bounding two tine receiving channels spaced apart a distance to receive two spaced tines of a forklift truck.

6. The palletized container of claim 5 further comprising a discharge chute depending from a central portion of said bag bottom.

7. The palletized container of claim 6 wherein said plurality of inflatable bladders comprise four elongated, mutually spaced, mutually parallel bladders with two of said bladders being inboard and two being outboard, and wherein said discharge chute depends from said bag bottom between said two inboard bladders.

8. The palletized container of claim 7 wherein said four bladders have bottoms and said container has two sheets which cover the bottoms of said four bladders and which bound the bottoms of said two tine receiving channels.

* * * * *